United States Patent [19]

Scholem

[11] Patent Number: 4,691,925

[45] Date of Patent: Sep. 8, 1987

[54] PORTABLE STEEL TARGET FOR PISTOL SHOOTING

[76] Inventor: Paul Scholem, P.O. Box 418, Grant, Fla. 32949

[21] Appl. No.: 777,422

[22] Filed: Sep. 18, 1985

[51] Int. Cl.[4] ..... F41J 1/10

[52] U.S. Cl. ..... 273/407; 248/159; 248/188.1

[58] Field of Search ..... 273/407, 408; 248/159, 248/163.1, 165, 440.1, 188, 158, 151, 150, 188, 188.8, 519, 523, 529; 40/606, 610

[56] References Cited

U.S. PATENT DOCUMENTS

| | | | |
|---|---|---|---|
| 1,687,790 | 10/1928 | Powers | 248/158 X |
| 1,729,539 | 9/1929 | Davis | 248/158 |
| 2,017,097 | 10/1935 | Hornberger | 248/188.1 X |
| 2,284,510 | 5/1948 | Cates | 273/407 |
| 2,372,111 | 3/1945 | Norberg | 273/407 |

*Primary Examiner*—Paul E. Shapiro

*Attorney, Agent, or Firm*—Antonelli, Terry & Wands

[57] ABSTRACT

A firearms target support structure is formed of a set of interengaging steel units, that are readily assembled/-disassembled for ease of transport and deployment. The target support structure comprises a base unit and an upright and target stop plate unit, each of which is preferably made of steel angle irons, prescribed portions of which engage one another. The base unit is comprised of a pair of steel angle irons legs that are bridged by a flat mounting plate opposite ends of which are welded to the angle irons. On the flat mounting plate a pair of spaced apart sections of steel angle iron extend vertically for receiving an upright support steel angle iron leg therebetween, so that one end of the upright angle iron support leg rests on the flat mounting plate. A short section of steel angle iron is affixed to the other end of the upright support leg and extends laterally of the leg to provide a mounting base for a steel circular target.

11 Claims, 2 Drawing Figures

PORTABLE STEEL TARGET FOR PISTOL SHOOTING

FIELD OF THE INVENTION

The present invention relates in general to firearm target support structures, and is particularly directed to a target support configuration that can be readily assembled/disassembled, and thereby easily transported and which, when deployed, offers the degree of rigidity and strength required of competition target supports.

BACKGROUND OF THE INVENTION

Firearm (e.g. pistol) target support structures, such as those employed by law enforcement agencies, military units, and shooting competition organizations, are usually configured as integral, heavy gauge metal (e.g. steel) frameworks consisting of a large number of interconnected braces that provide a rigid assembly on which various target stop plates are mounted. As a result, such a support structure is effectively permanent, i.e. it cannot be readily disassembled, transported and reassembled for use at different shooting ranges. This drawback of conventional structures is especially pronounced where support for multiple targets is required (e.g. for a "Kansas City Speed Shoot" competition).

SUMMARY OF THE INVENTION

In accordance with the present invention the inability of conventional heavy gauge metal target support structures to be easily disassembled, transported and redeployed, while still providing the degree of strength and rigidity required for absorbing the impact of numerous projectile hits during firearms competitions, using targets mounted on such structures, is overcome by a target support structure made of a set of interengaging steel units, that are readily assembled/disassembled for ease of transport and deployment. To this end, the target support structure of the present invention comprises a base unit and an upright and target stop plate unit each of which is preferably made of steel angle irons, prescribed portions of which engage one another to provide a rigid target support assembly that offers effectively the same degree of strength of conventional arrangements, but which is considerably less complicated and bulky.

Pursuant to the invention, the base unit is comprised of a pair of steel angle iron legs that are bridged by a flat mounting plate, opposite ends of which are welded to the angle irons (preferably at mid length positions therealong). On the flat mounting plate a pair of spaced apart sections of steel angle iron extend vertically for receiving an upright support steel angle iron leg therebetween, so that one end of the upright angle iron support leg rests on the flat mounting plate. A short section of steel angle iron is affixed to the other end of the upright support leg and extends laterally of the leg to provide a mounting base for a steel target (e.g. a steel circular target).

Advantageously, because the material and the configuration of the material of which the target support structure is made provides strength and rigidity, and enables the separate units to be securely retained in engagement with one another during use, but easily disassembled and transported, the present invention provides the firearms user with a target support structure that is both versatile and cost effective as contrasted with conventional effectively permanent, complex framework structures.

DETAILED DESCRIPTION

Figure 1:
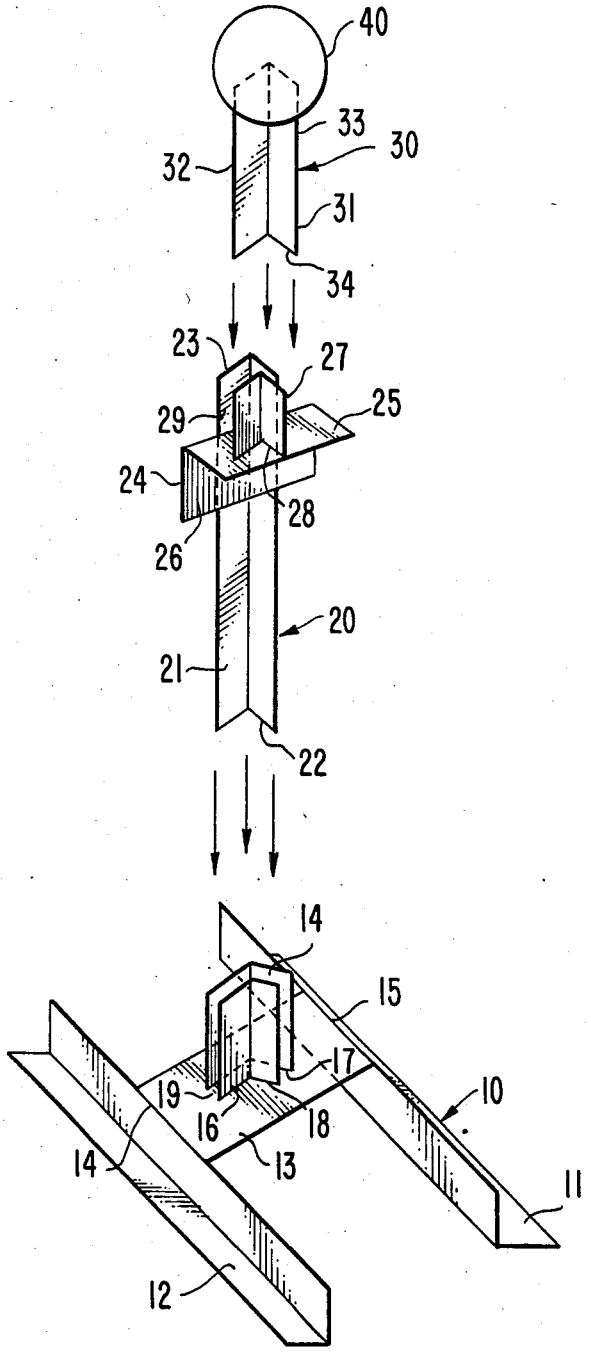
FIG. 1 is an exploded view of an embodiment of a target support structure in accordance with the present invention.

Referring now to FIG. 1, there is shown an exploded view of an embodiment of the target support structure in accordance with the present invention. As shown in the Figure, the support structure upon which a steel target stop plate 40 (shown as a circular target in FIG. 1) is mounted comprises a base unit 10, an upright unit 20 and a target support unit 30. Advantageously, each of the units is comprised of sections of steel angle iron which, due to their "V" or right angle cross-section, provide both strength and versatility in terms of being able to be joined (e.g. welded) together and in forming mutual engagement portions through which the respective units are held in place but readily disassembled for transport. Moreover, the "V" shape of the angle iron members provide bullet deflection. It is preferred, therefore, that the corner of the "V" of the angle iron members face the shooter.

The base unit is preferably comprised of a pair of angle iron legs 11 and 12 that are bridged by and affixed to a flat mounting plate 13. As shown in FIG. 1, opposite edges 14 and 15 of the flat mounting plate are welded along edges of the angle irons 11 and 12. However, it is equally acceptable to invert the legs 11 and 12 and weld the plate 13 along the corner edges of the angle iron legs 11 and 12. Preferably, plate 13 is located midway of each of the legs so as to provide a balanced support structure, with equal portions of the legs extending beyond the edges of the plate 13.

Upon the top surface of the plate 13 are mounted a pair of steel angle iron support sections 14 and 16, spaced apart from one another by a gap 19 therebetween. Preferably, the gap 19 is slightly larger than a steel angle iron leg 21 of upright support unit 20 which is to be inserted between angle iron sections 14 and 16 of the base support unit. Each of angle iron sections 14 and 16 is preferably welded along the respective bottom portions 17 and 18 thereof to the top surface of flat plate 13.

In an actual embodiment of the invention, each of angle iron legs 11 and 12 may comprise a $1'' \times 1'' \times \frac{1}{8}''$ section of steel angle iron approximately four feet in length. The support plate 13 may comprise a one-quarter inch thick steel plate 13 upon which a pair of $2'' \times 2'' \times \frac{1}{4}''$ angle irons sections 14 and 16 are mounted, each section 14 and 16 being approximately four inches in length.

The upright support unit 20 is comprised of a vertically extending angle iron support leg 21, preferably formed of the same angle iron material as are support sections 14 and 16 of the base unit 10. The lower edge 22 of vertical support leg 21 is intended to be inserted into the gap or opening 19 between sections 14 and 16 of the base unit, as shown in FIG. 1. Mounted near the top edge 23 of leg 21 is an angle iron cross plate 24 having respective angled sections 25 and 26. Section 26 is preferably welded at its outer surface to the vertically extending outer edges of leg 21, while section 25 thereof, which is essentially horizontal, extending 90° from section 26, has affixed thereon a short angle iron section 27 the top edge 29 of which is substantially aligned with the top edge 23 of vertical support leg 21 and is spaced apart therefrom by a gap 27 therebetween. Gap 27, like gap 19 between sections 14 and 16 of the base unit 10, is designed to accommodate a vertical leg portion 31 of the target support unit 30, to be described below.

More specifically, the target support unit 30 is comprised of a short vertical angle iron leg section 31, the lower edge 34 of which is designed to fit into the opening 27 between vertical leg 21 of the upright support unit 20 and section 27 thereof. Along the top portions of edges 32 and 33 of angle iron section 31 a circular target stop plate 40 is mounted. Typically, target stop plate 40 may be made of $\frac{3}{8}''$ steel of a diameter on the order of 8, 12 or 24 inches as is customary in present day target structures.

Like support sections 14 and 16 of base unit 10 and vertical leg 21 of upright support unit 20, the target support angle iron leg 31 may be comprised of a length (e.g. six inches) of $2'' \times 2'' \times \frac{1}{4}''$ steel angle iron. It should be observed, however, in connection with these dimensions and the other dimensions given, that the parameters employed in the exemplary embodiment described herein are not to be considered limitative of the invention, but merely illustrative of a practical structural configuration through which the structural rigidity and strength of the assembled structure may be achieved, while still providing ease of disassembling and transport ability.

Figure 2:
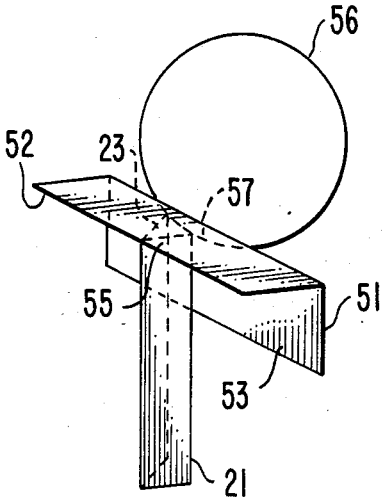
FIG. 2 shows a modified embodiment of the upright and target support leg employed in the target support structure of the present invention.

Rather than employ separate upright and target plate units such as units 20 and 30, illustrated in FIG. 1, the two may be combined in an integral fashion in the manner shown in FIG. 2. As shown therein, at the top edge 23 of vertical support leg 21, a horizontally extending angle iron plate 51, having a top portion 55 and a side portion 53, is affixed to leg 21, with a steel target stop plate 56 affixed to the side plate portion 53 at a lower circular edge portion 57 thereof. As is the case with the embodiment shown in FIG. 1, each of the respective angle iron portions and the target plate itself may be welded to one another.

As will be appreciated from the foregoing description, through the use of a readily available support material (steel angle iron) which is easily severed into separate sections of desired length, separate units of a steel firearm support structure may be readily made for ease of transport, rapid assembly and deployment at a pistol target range. Because of their inherent strength, rigidity and durability, the steel angle iron components of the target structure offer effectively the same degree of impact absorption capability provided by more complex and permanent target support frameworks of the prior art, yet are not bulky and are considerably less expensive.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

I claim:

1. A firearms target support structure comprising a base unit having a pair of leg members and a horizontal support plate member affixed to said leg members along spaced apart portions of said plate member, said plate member having a vertically extending engagement section which engages an upright leg member upon which a firearms target is retained, an upright unit having a vertical leg portion one end of which is mechanically engaged by the vertically extending engagement section of said base unit and the other end of which retains thereon said target, and wherein said vertically extending engagement section, said upright leg member and said vertical leg portion of said upright unit are comprised of interfitting angle iron members.

2. A firearms target support structure according to claim 1, wherein said other end of said upright unit has a vertically extending engagement section which engages a leg portion of a target mounting unit through which said target is retained thereby, said target mounting unit having a leg member to one end of which said target is affixed and the other end of which is mechanically engaged with the vertically extending engagement section of said upright unit.

3. A firearms target support structure according to claim 2, wherein the vertically extending engagement section of said plate member is comprised of a pair of angle iron members each of which is vertically mounted on said plate member with a space therebetween for receiving the vertical leg portion of said upright unit, said vertical leg portion of the upright unit comprising an angle iron leg member one end of which fits between the pair of angle iron members of the vertically extending engagement section of said plate member and the other end of which retains said target thereon.

4. A firearms target support structure according to claim 3, wherein said other end of said angle iron leg member comprises a horizontally extending angle iron member having a section of angle iron mounted thereon so as to form with a top portion of said angle iron leg member a pair of angle iron members thereby providing the vertically extending engagement section of said upright unit, into which the leg member of said target unit is insertable to be retained thereby, said vertical leg member of said target unit comprising an angle iron leg member to one end of which said target is affixed and the other end of which mechanically engages the pair of angle iron members of which the vertically extending engagement section of said upright unit is formed.

5. A firearms target support structure according to claim 4, wherein said angle iron members are comprised of steel angle iron material.

6. A firearms target support structure according to claim 5, wherein the leg members of said base unit are comprised of steel angle iron material.

7. A firearms target support structure according to claim 1, wherein said other end of said upright unit has a target mounting portion through which said target is retained on said upright unit.

8. A firearms target support structure according to claim 7, wherein said vertically extending engagement section of said plate member is comprised of a pair of angle iron members each of which is vertically mounted on said plate member with a space therebetween for receiving a vertical leg portion of said upright unit, said vertical leg portion of said upright unit comprising an angle iron leg member one end of which adapted to fit between the pair of angle iron members of the vertically extending engagement section of said plate member and the other end of which retains said target thereon.

9. A firearms target support structure according to claim 8, wherein said other end of said angle iron leg member has a horizontally extending angle iron member affixed thereto for providing a mounting plate by way of which said target is affixed to and retained by said angle iron leg member.

10. A firearms target support structure according to claim 9, wherein the leg members of said base unit are angle iron leg members.

11. A firearms target support structure according to claim 10, wherein the angle iron leg members of said base and upright units are comprised of steel angle iron material.

* * * * *